US005184930A

United States Patent [19]

Kuhn

[11] Patent Number: 5,184,930

[45] Date of Patent: Feb. 9, 1993

[54] VEHICLE LIFTING SYSTEM AND METHOD

[76] Inventor: Charles J. Kuhn, 10520 Plainview Ave., Tujunga, Calif. 91042

[21] Appl. No.: 593,681

[22] Filed: Oct. 5, 1990

[51] Int. Cl.[5] ..... B66F 5/00

[52] U.S. Cl. ..... 414/427; 254/2 B; 254/DIG. 10; 254/93 L; 187/8.41; 414/678

[58] Field of Search ..... 414/426, 427, 428, 429, 414/678, 12, 785; 187/8.41, 8.45, 8.59, 8.74, 8.75, 17; 254/93 L, 2 R, 2 B, 2 C, DIG. 10

[56] References Cited

U.S. PATENT DOCUMENTS

| | | | |
|---|---|---|---|
| 2,792,913 | 5/1957 | Capgras | 187/8.41 |
| 3,035,812 | 5/1962 | Wineteer | 414/427 X |
| 3,044,747 | 7/1962 | Nolden | 254/2 B |
| 3,271,006 | 9/1966 | Brown et al. | 254/2 B |
| 4,200,419 | 4/1980 | Rogers, Jr. | 414/12 |
| 4,599,034 | 7/1986 | Kennedy et al. | 414/678 |
| 4,706,458 | 11/1987 | Corghi | 187/8.41 X |

FOREIGN PATENT DOCUMENTS

| | | | |
|---|---|---|---|
| 926932 | 4/1955 | Fed. Rep. of Germany | 414/678 |
| 1115154 | 4/1956 | France | 187/8.41 |
| 1373217 | 8/1964 | France | 187/8.41 |

*Primary Examiner*—Frank E. Werner
*Attorney, Agent, or Firm*—Christie, Parker & Hale

[57] ABSTRACT

A vehicle lifting system includes two pneumatic jacks each equipped with a detachable adapter for engaging a vehicle tire to lift the vehicle by its tires. The adapter has a fork with two arms that support the tire at two points on its circumference, on opposite sides of the tire's axis of rotation. The system also includes an air source connected to the jacks by a T-joint and separate air lines so that the jacks lift in unison. In another embodiment, the adapter is a receptacle for holding an end of a rigid lifter bar. Each jack is positioned on an opposite side of the vehicle with the lifter bar under the vehicle frame and extending between the jacks. The bar is equipped with body clamps to prevent the vehicle body from slipping during lifting.

9 Claims, 9 Drawing Sheets 32
36
8
28
1
34
50
52
36a
2
36b
38a
38
38a
62
62
60
60
18
44
44
18
16
16
14
12
12

VEHICLE LIFTING SYSTEM AND METHOD

FIELD OF THE INVENTION

The present invention relates to an airlift system for and a method of lifting vehicles. More specifically, the invention is a portable airlift system for and method of lifting unibody vehicles without causing body damage by distributing the lifting load onto the tires or across the body.

BACKGROUND OF THE INVENTION

In the past, portable pneumatic jacks have been popular for lifting lightweight vehicles, such as for inspecting body damage and repairing it. Currently, lightweight vehicles are constructed with relatively fragile unibody frames. The unibody frames lack the strong cross-members that made lifting older vehicles of frame rail construction easier and safer. Today's plastic bumpers also do not support lifting loads from conventional portable jacks. As a result, the vehicle can be damaged when lifting the vehicle. Moreover, it is difficult to synchronize two jacks operating on opposite sides of a vehicle to lift one end of the vehicle. If the jacks are sufficiently out of synchronization, the frame or body can be damaged. There is a particular need for quickly and easily lifting the entire front end or rear end of a damaged vehicle, or the entire vehicle itself, prior to assessing the extent of damage. Estimated damage report for insurance companies requires such lifting devices.

SUMMARY OF THE INVENTION

The invention is a portable pneumatic jacking system for and method of lifting a lightweight vehicle, such as a vehicle of unibody construction. In one embodiment, the system includes two portable pneumatic jacks, a compressed air source, and means for connecting both jacks with the air source. Each jack has an adapter formed by two arms for lifting the vehicle by lifting a respective tire on each side of the vehicle.

Alternatively, each jack has a holder or receptacle for cooperating with each other to support a lifter bar between the two jacks and underneath the vehicle to lift the vehicle by lifting the bar.

In a preferred embodiment, the adapter is detachable from each jack, and so is the holder.

In addition, the jacks are connected to a common air source using a T-joint with air pressure supply lines arranged so that lifting force on the tires (using the adapter), or on both sides of the vehicle (using the lifting bar) is equalized during lifting to uniformly lift the opposite sides of the vehicle as the jacks lift in unison.

DETAILED DESCRIPTION

The invention is a portable vehicle lifting system including pneumatic jacks equipped with means to lift the vehicle without damaging the frame.

Figure 1:
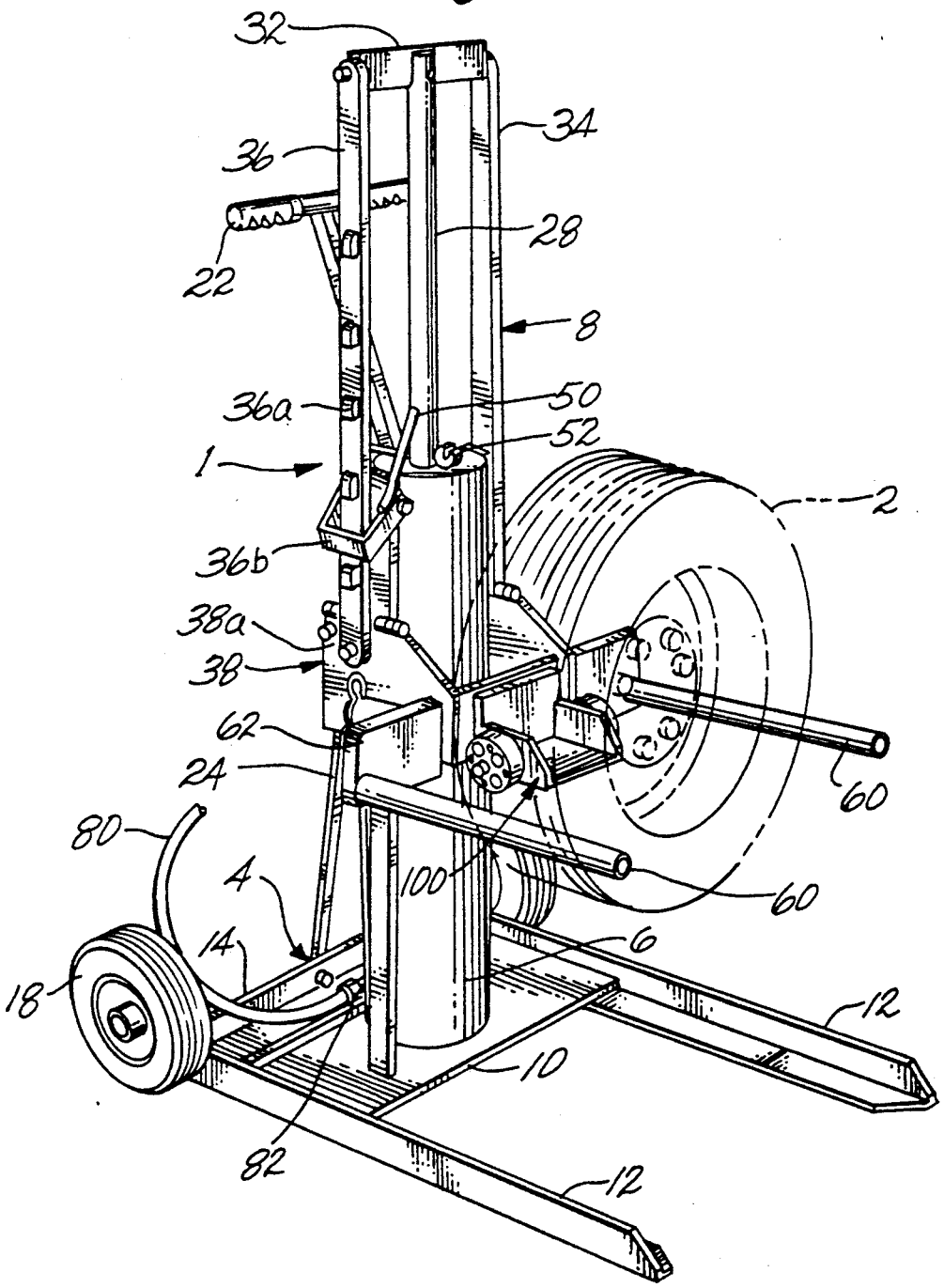
FIG. 1 is a front perspective view of one pneumatic jack according to an airlift system of the invention showing a tire (in phantom) of a vehicle being lifted.
Figure 2:
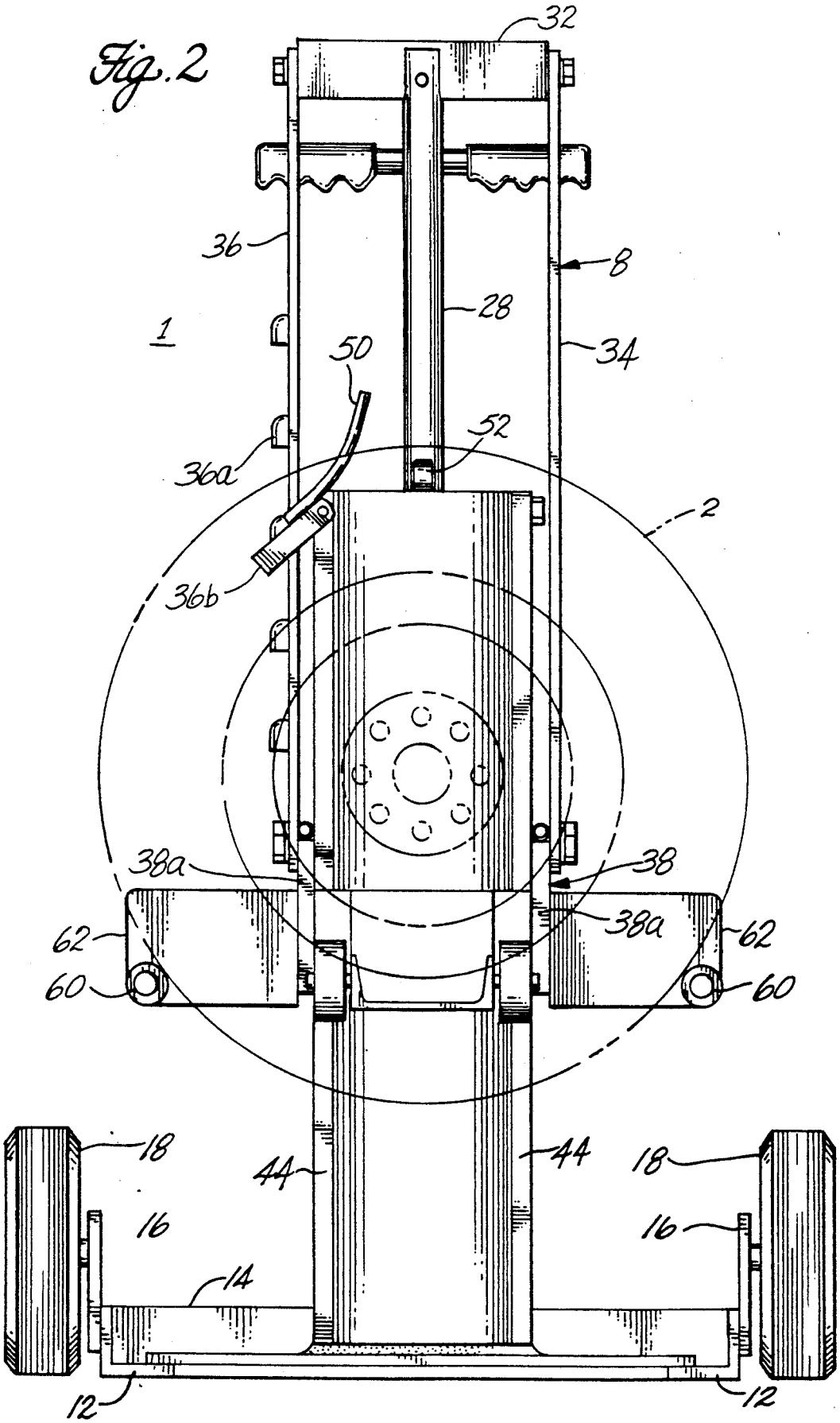
FIG. 2 is a front elevational view of the jack and tire of FIG. 1.

FIG. 1 shows a perspective view, and FIG. 2 shows a front view, of a portable pneumatic jack 1, according to the invention, showing a tire 2 (in phantom) of a vehicle being lifted. Portable pneumatic jacks of a type to which the invention is applicable are commercially available and are well known in the autobody industry. The jack has a lower frame 4, an upright pneumatic cylinder 6 mounted on the frame 4, and a lifting assembly 8 extending above the cylinder.

The frame 4 includes a base panel 10 welded to two spaced-apart legs 12 of angle iron projecting to the front side of the cylinder. The stabilizing legs are welded to a cross brace 14, also of angle iron, and two wheel support brackets 16 are welded to the legs 12 to rotatably support wheels 18. The frame also includes a tilted handle 22 welded to a diagonal brace 24 bolted to the cylinder 6 and to the cross brace 14.

Figure 3:
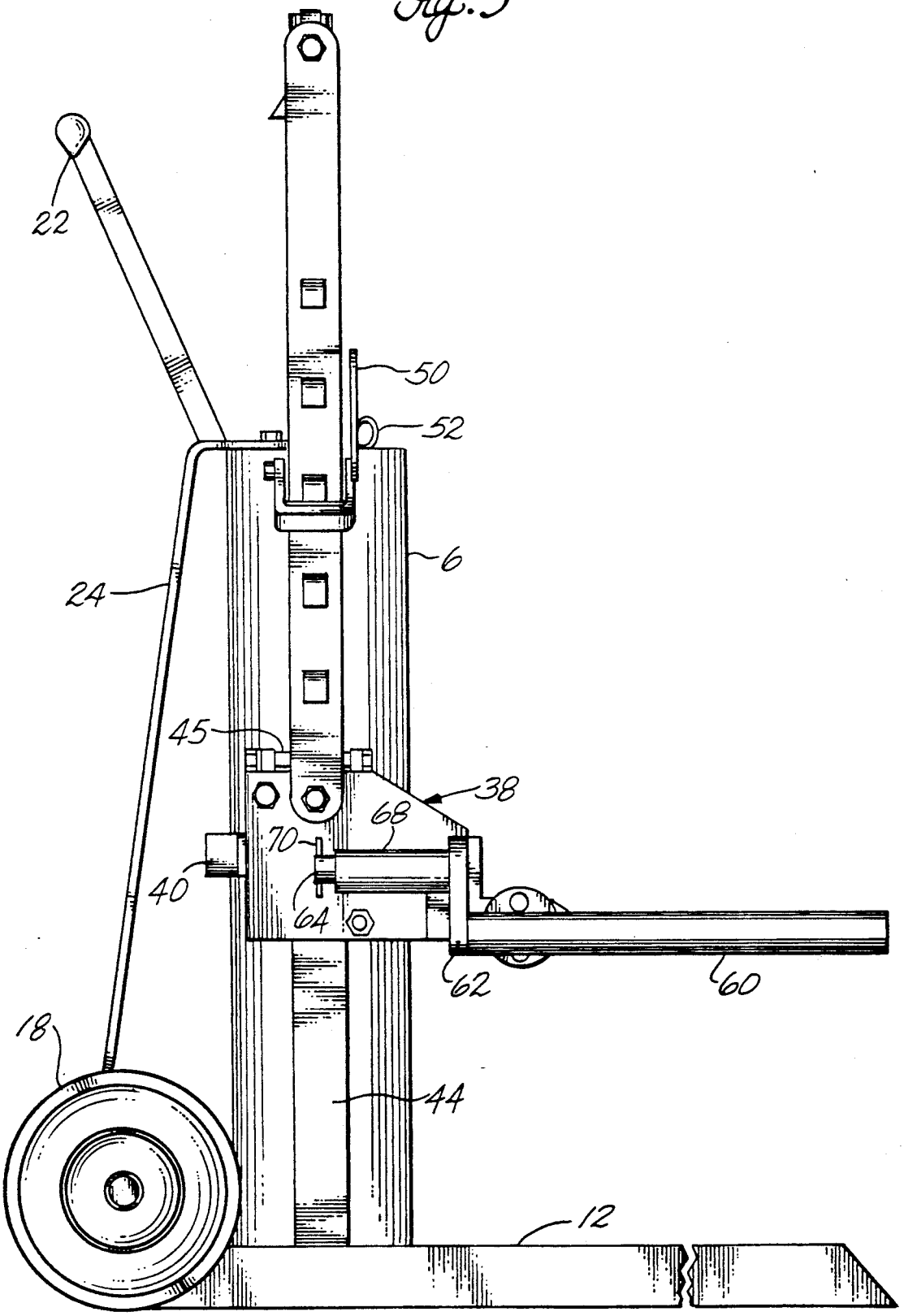
FIG. 3 is a side view of the jack of FIG. 1.
Figure 4:
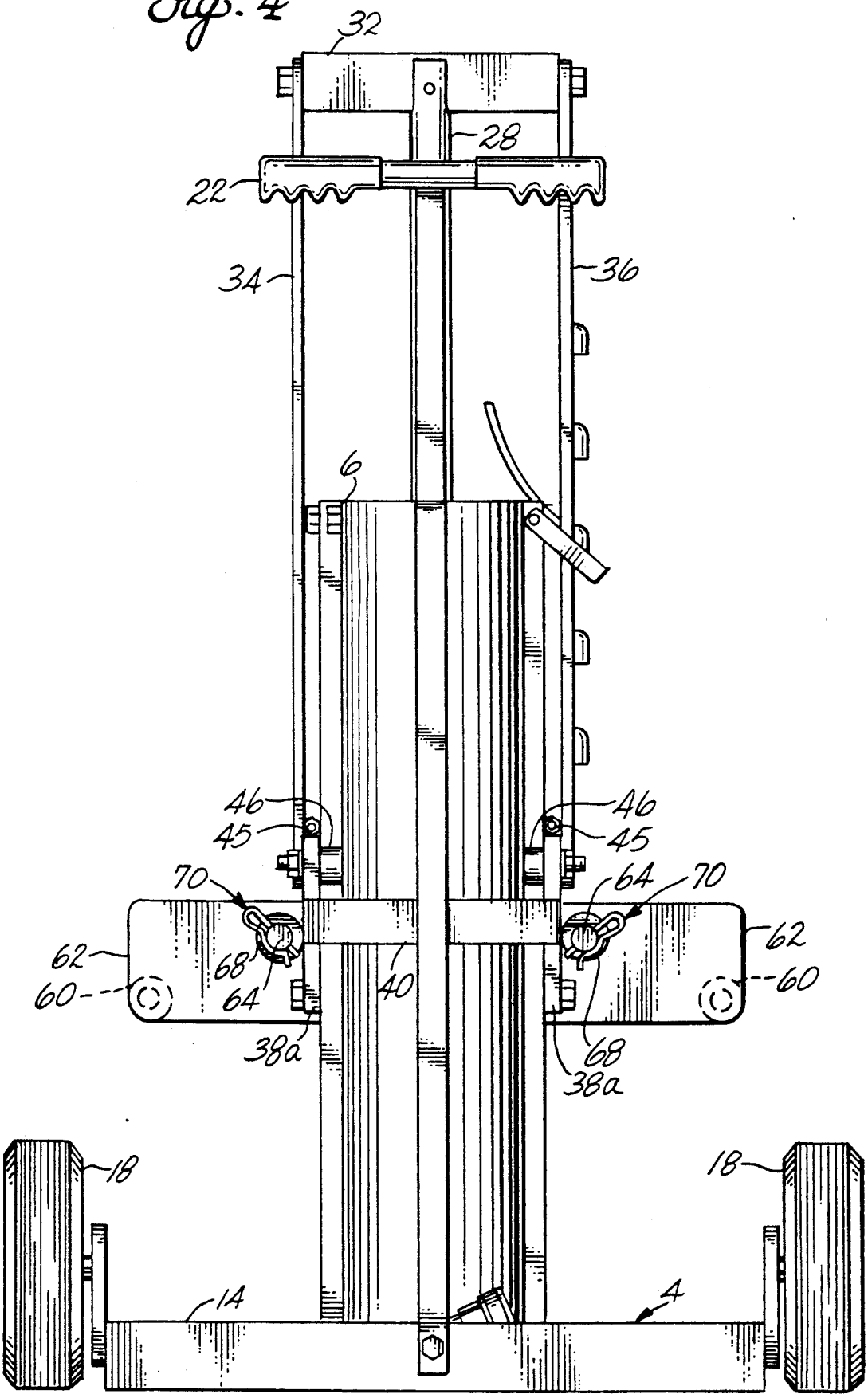
FIG. 4 is a rear view of the jack of FIG. 1.

The lifting assembly 8 mounts to the top of a piston coupling rod 28 extending above the cylinder 6. The rod 28 has a slot in its top for receiving a thick cross brace 32 bolted to the rod. The brace 32 bolts at each end to the top of two vertical lifter bars 34, 36 on opposite sides of the cylinder. These bars bolt at their bottom to the sides of a carriage which includes a generally U-shaped mounting bracket 38 having a rear brace 40 (FIG. 3) extending behind the cylinder. The mounting bracket 38 slidably mounts on two vertical guide bars 44, which are welded to a base panel 10 at their bottoms and bolted to cylinder 6 at their tops. For example, each arm 38*a* of the bracket 38 supports three roller bearings, one contacting each edge of each bar 44 and the remaining one 45 (FIG. 3) contacting the exposed side of each bar 44. Roller bearings 46 contacting corresponding rear edges of the bar 44 are shown in the rear view of FIG. 4. The rod 28 is carried on a piston (not shown) contained in the cylinder so that air pressure forced into the cylinder on the underside of the piston raises the piston rod and its attached lifting assembly.

One lifter bar 36 has a ratchet system 36*a* on it, such that a ratchet arm 36*b* pivots to allow upward movement of the lifting assembly 8, but prevents downward movement by engaging corresponding ratchet lugs 36*a* which act as stops. For lowering the assembly 8, the ratchet arm locks out of the way by pressing a linking rod 50 into a clip 52.

Figure 5:
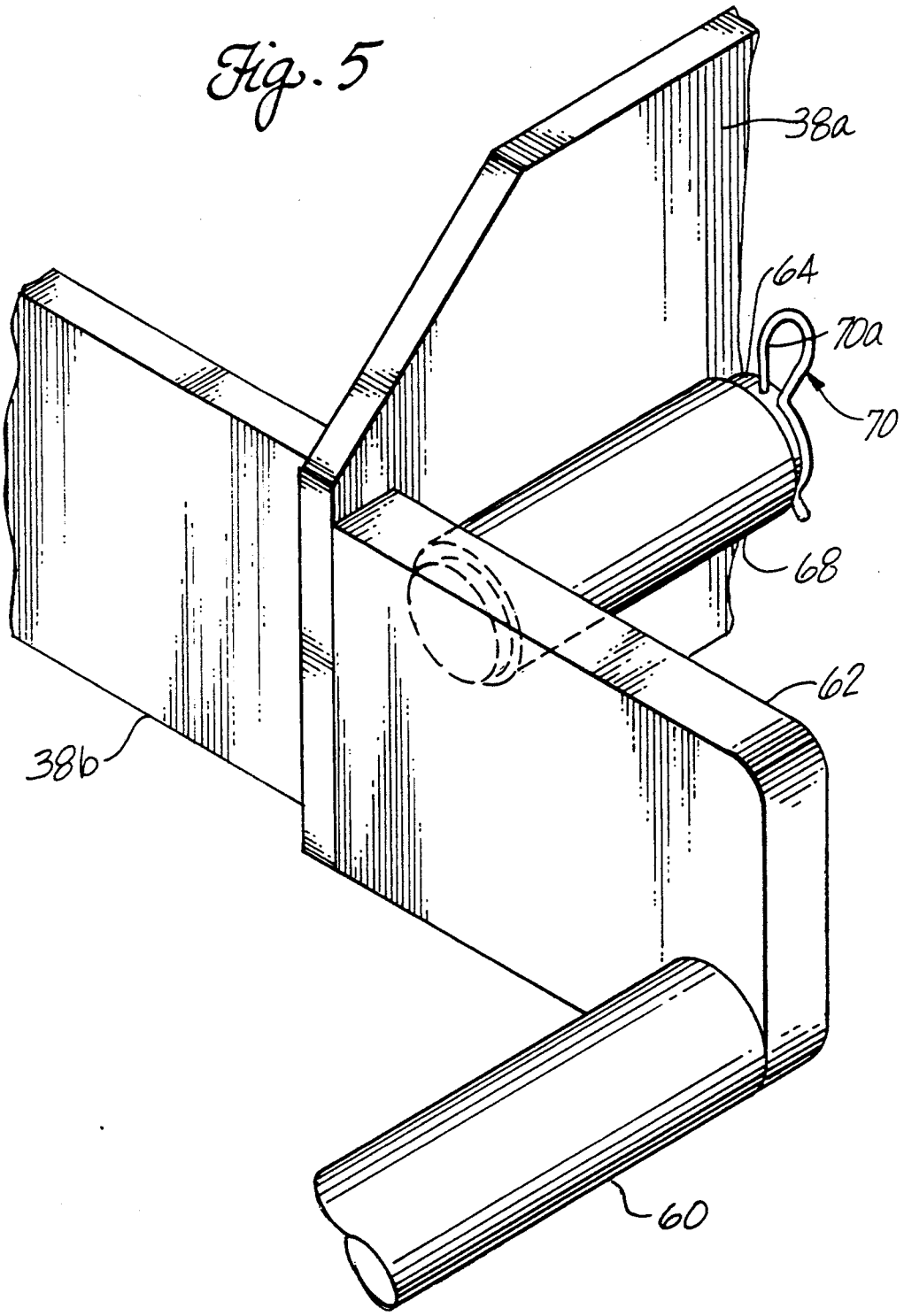
FIG. 5 is an enlarged perspective and cutaway view of a tire engaging arm of the jack of FIG. 1.

In accordance with one embodiment of the invention, the lifting assembly 8 includes a fork-like tire lifting adapter or attachment removably, but rigidly, attached to the carriage-like lifting assembly. The tire lifting adapter is formed by two generally horizontal, spaced-apart, and parallel arms 60 (tubes or rods). The arms 60 are each welded to the front side of a plate 62 having a separate rod 64 welded to each side of its rear. The rods 64 slidably fit into corresponding tubes 68. The tubes are open-ended, and tube 68 is welded to each side 38*a* of bracket 38 on the lifting assembly. Each rod 64 is sufficiently long such that its rear extends out of the tube 68. As best shown in the detailed view of FIG. 5, the rear of the rod 64 has a bore through which there is a straight portion 70*a* of a spring clip 70 to serve as a removable stop.

Figure 6:
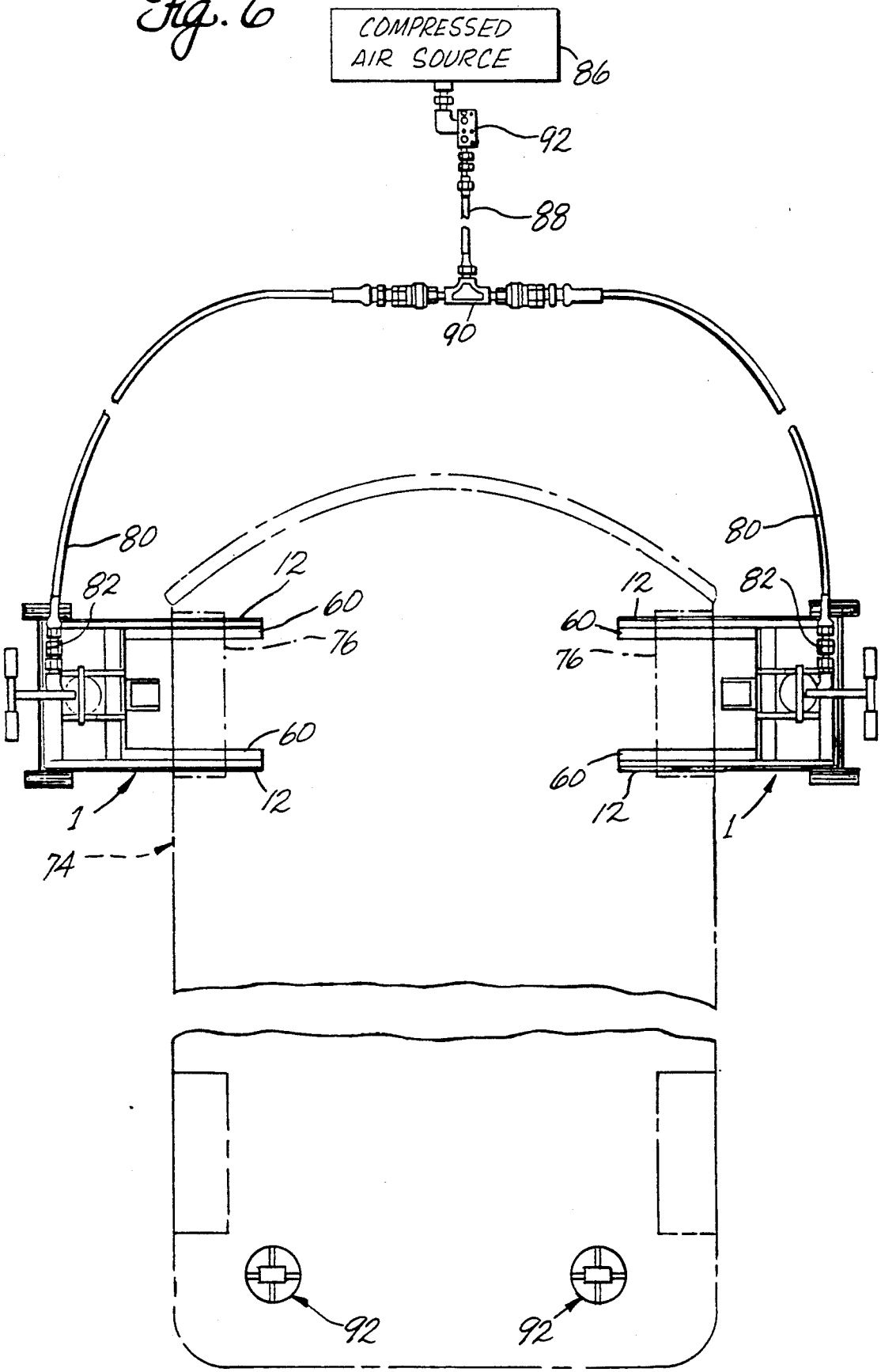
FIG. 6 is a top view of the airlift system according to the invention showing two jacks and a vehicle (in phantom) being lifted by its front tires, and also showing a compressed air source and tubing connecting the air source to the jacks.

To lift a vehicle by its tires, as shown in FIG. 6, two jacks 1, identical to that shown in FIGS. 1–5, are positioned on opposite sides of a vehicle 74. The pneumatic cylinder 6 of each jack should have any air evacuated from it such that the lifting assembly, including each lifting arm 60, plate 62, and rod 64, is at its lowest position, e.g., with each lifting arm 60 proximate each stabilizing leg 12. A mechanic moves the jacks such that their lifting legs 12 are positioned under the car, straddling a tire on opposite sides of the tire's axis of rotation. The lifting arms 60 also straddle the tire's point of contact with the ground.

The lifting arms 60 should be parallel, or substantially parallel, to each other, and closer together than a standard tire diameter, but far enough apart to hold the tire from the bottom and prevent the tire from accidentally coming out of the lifting arms.

Each jack connects to an air source via a separate hose 80 connected to an air inlet port 82 of the cylinder. In the system according to the invention, there is a common compressed air source 86 connected to each hose 80 by a feeder hose 88 and a T-joint 90. (The air hoses and T-joint are shown exaggerated in size for clarity of understanding the principles involved.) The common air pressure source achieves uniform lifting and lowering by the two jacks. A lift/lower control valve 92 preferably has a panel with one knob to input air to the cylinders and another knob to let air out of the cylinders.

To begin lifting, the mechanic turns on the air pressure, and the piston rod 28 of each jack rises, thus lifting the bracket 38 and lifting arms 60 of each fork-like tire lifting adapter. The lifting arms 60 of each fork engage the tire and lift it (see FIG. 1), thus transferring the stress from the lifting force and weight of the vehicle to the tires. The tires handle this stress well as compared with the unibody portion of the car. The tire lifting forks are identical in configuration and weight. Air pressure from the common source is transmitted by the T-fitting 90 uniformly to the cylinders automatically, and the pair of lifting forks on both sides of the vehicle lift upwardly in unison to pick up both sides of the vehicle uniformly. Retaining air pressure in the system maintains the car in its lifted position.

Once the jacks have lifted one end of the car sufficiently high, safety stands can be positioned under the car. The jacks can then be lowered so that the end of the car rests on the stands. Then the jacks are free to use on the other end of the car. In FIG. 6, safety stands 92 are shown under the rear end of the car, which has already been lifted. Once the front of the car is lifted, the entire vehicle can be supported on safety stands to provide working space underneath. Alternatively, each wheel of the vehicle can be lowered onto shop transport dollies to move the car around, if necessary.

Figure 7:
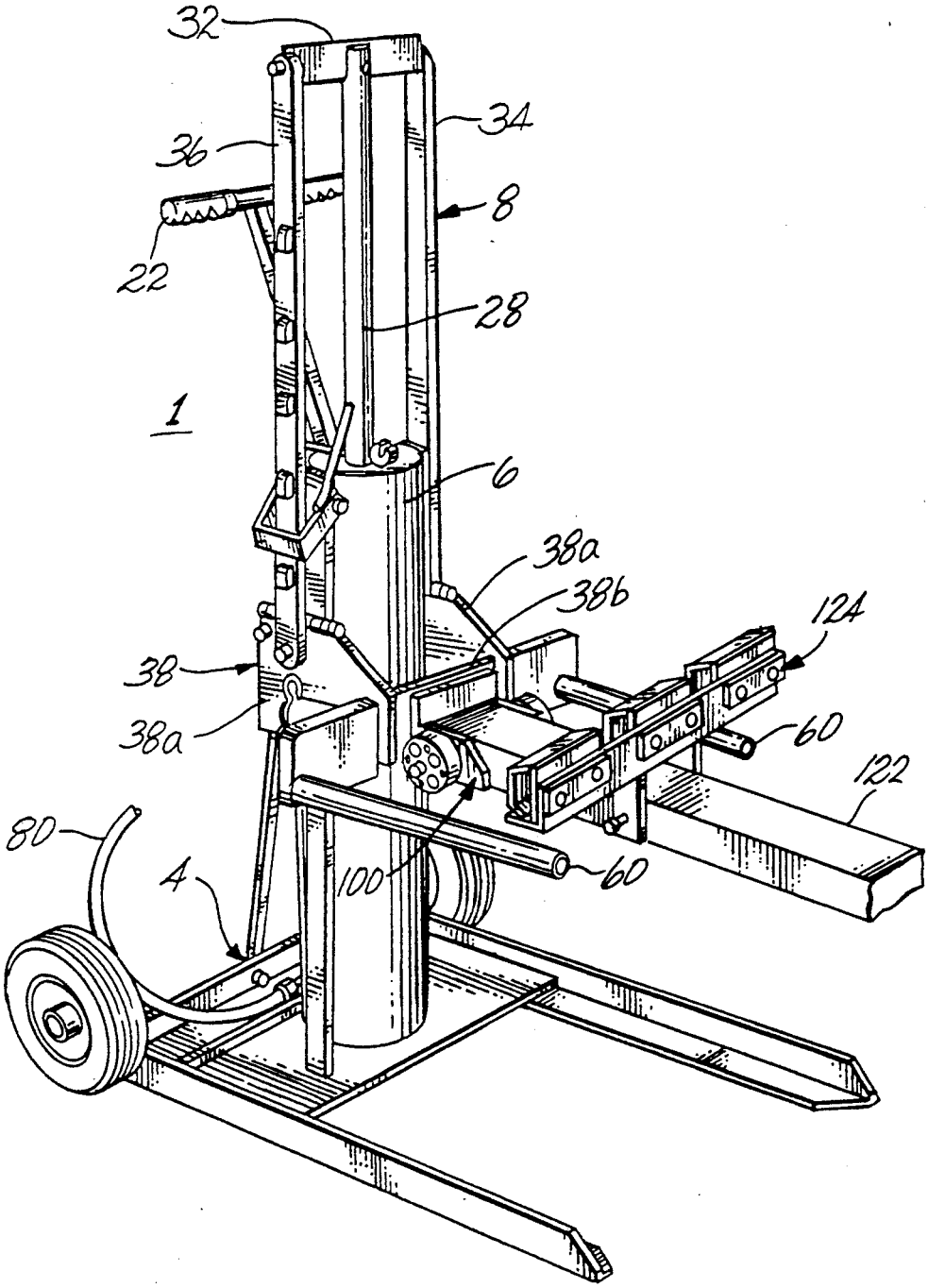
FIG. 7 is a front perspective view of the jack of FIG. 1, showing one end of a vehicle lifting bar being lifted.
Figure 8:
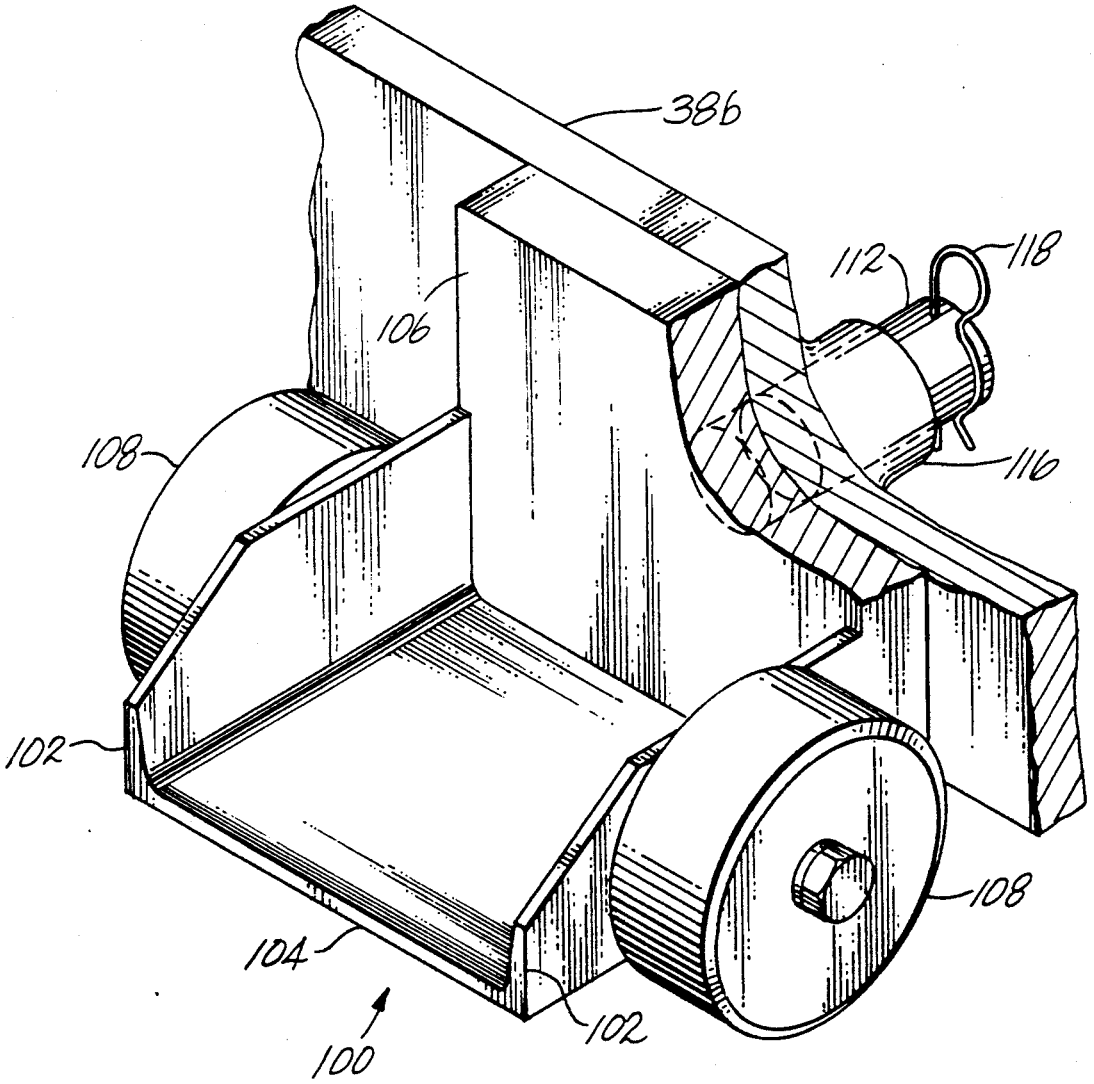
FIG. 8 is an enlarged perspective and cutaway view of a bar holder of the jack of FIG. 1.

In another aspect of the invention, the jack has a detachable trough-like receptacle for holding one end of a lifter bar. With reference to FIGS. 7 and 8, a detachable receptacle 100 includes two sides 102, a bottom 104, and a rear wall 106. The sides 102 have two wheels 108 rotatably mounted thereto, and the rear wall 106 has a rod 112 welded to its rear side. The rod 112 slidably fits into a tube 116 welded to a front panel 38*b* of the mounting bracket 38. A spring clip 118 fits in a bore in the rod 112 to serve as a removable stop. It should be noted that although FIGS. 1–3 and 6–7 show the receptacle 100 in place, along with the tire lifting assembly, as both the receptacle 100 and tire lifting assembly 60, 62, 64 operate independently, either being removed while the other is being used.

Figure 9:
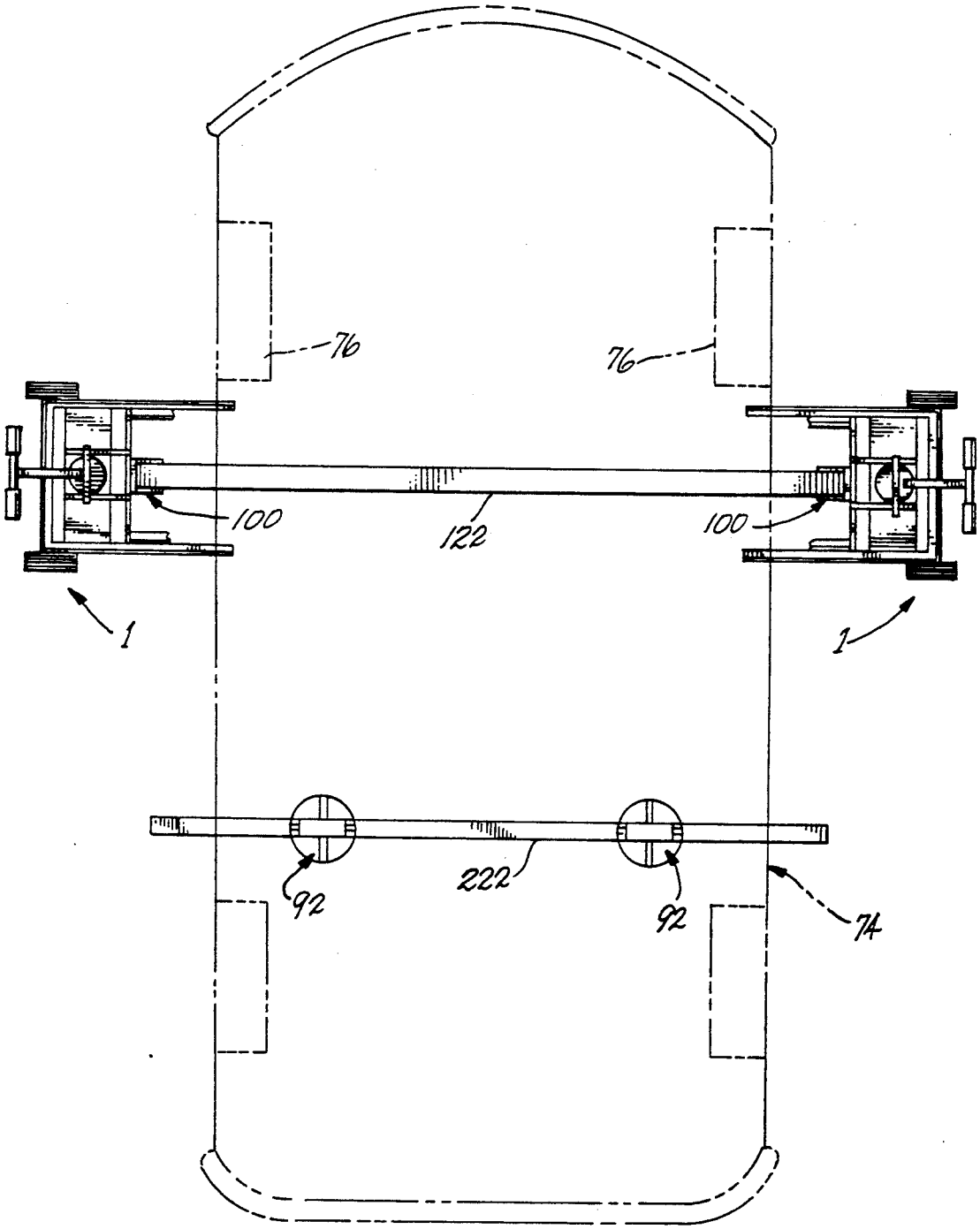
FIG. 9 is a top view similar to FIG. 6 but showing a vehicle lifting bar engaging the underside of the front of a vehicle (in phantom).

The receptacle 100 supports one end of a lifter bar 122, which is shown in FIG. 7 with a vehicle body clamp assembly 124 bolted to it. As shown in FIG. 9, another jack 1 with another receptacle 100 supports the other end of the bar 122 to lift vehicle 74 from underneath its body. Although not shown in FIG. 9, both ends of the bar 122 preferably have a body clamp assembly to prevent the vehicle from slipping during lifting or when in the elevated position. The lifter bar and clamps can be positioned under the vehicle body using shop transport dollies, then the jacks positioned with the receptacle assemblies under the bar's ends.

Also not shown in FIG. 9 is the air source and its connection to each jack, as this is the same as in FIG. 6. However, as with FIG. 6, FIG. 9 shows two safety stands 92 for supporting a lifter bar 222 and the rear of the vehicle in an elevated position, as it has already been lifted by the jacks and the bar 222.

The invention is not limited to the disclosed embodiments. Rather, it is defined by the appended claims.

What is claimed is:

1. A system for lifting a vehicle, the vehicle having opposite sides with corresponding lifting points at essentially a same level on an underside of the vehicle, the system comprising:

two jacks, each jack comprising a cylinder having a movable piston and a piston rod connected to the piston and adapted for vertical linear travel from the cylinder in response to fluid pressure applied to the piston inside the cylinder;

a carriage to follow travel of the piston rod on each jack;

lifting means connected to each carriage for releasably engaging a corresponding one of the lifting points on the underside of the vehicle; and a fluid pressure supply system adapted for connection to a fluid pressure source and having a fluid pressure distributing T-joint with an inlet for connection to a fluid pressure supply line from the fluid pressure source, and a pair of fluid pressure distribution lines connected to outlets of the T-joint for simultaneously uniformly distributing fluid pressure from the pressure source directly to the cylinders of the two jacks so the pistons and piston rods thereof are uniformly lifted to equally and simultaneously raise the carriages and their corresponding lifting means, thereby equally raising the vehicle from the lifting points thereon.

2. A system according to claim 1 in which the lifting means includes a lifting bar for engaging the lifting point on the underside of the vehicle's body, and further including a receptacle associated with each carriage for supporting a respective end of the lifter bars so that each receptacle moves up and down to lift the vehicle up and lower the vehicle down by the lifter bar with up and down movement of the jack, respectively.

3. The system according to claim 2 further comprising a vehicle body clamp mounted proximate each end of the lifter bar, the clamp having means for engaging the lifting point on the underside of the vehicle body to prevent slipping of the vehicle during lifting and lowering.

4. The system according to claim 1 wherein both of the jacks are pneumatic jacks, and the inlet to the T-joint is connected to an air source for supplying air under pressure to both jacks via the separate fluid distribution lines for equally distributing air under pressure to the cylinders of the jacks for uniform lifting and lowering of the vehicle.

5. The system according to claim 1 in which the vehicle has a pair of tires extending parallel to one another on opposite sides of the vehicle, in which said pair of tires are aligned on a common axis of rotation extending across a width of the vehicle, and in which the carriage of each cylinder is connected to a corresponding lifting means comprising a pair of arms for engaging a lower underside of a corresponding vehicle tire on opposite sides of the tire's axis of rotation so that said uniform distribution of fluid pressure to the cylinders equally raises the separate pairs of lifting arms carried by the respective jacks for lifting the vehicle from the underside of the tires.

6. The system according to claim 5 in which the pair of arms are on a fork releasably attachable to the carriage.

7. The system according to claim 1 in which the vehicle has a pair of tires extending parallel to each other on opposite sides of the vehicle and aligned on a common axis of rotation, and in which the vehicle is lifted by pressure contact with underside portions of the aligned tires, the system further including a tire lifting adapter for mounting on the carriage to lift the vehicle by contact with the tire of the vehicle, the adapter having a pair of arms spaced apart by a distance less than the diameter of the tire for engaging opposite bottom sides of the tire on opposites sides of the tire axis of rotation, and means for attaching the tire lifting arms to the carriage for up and down movement with the piston rod, the cylinder maintaining sufficient pressure on the piston to raise the tire lifting arms against the weight of the vehicle to lift the vehicle.

8. A system for lifting a vehicle, the vehicle having a pair of tires extending parallel to each other along opposite sides of the vehicle, said tires being aligned on a common axis of rotation extending across a width of the vehicle, the system comprising:

two pneumatic jacks, each jack comprising a pneumatic cylinder having a movable piston and a piston rod connected to the piston and adapted for vertical linear travel from the cylinder in response to air pressure applied to the piston inside the cylinder;

a carriage to follow travel of the piston rod on each jack;

lifting means connected to each carriage, each lifting means comprising a separate fork with a pair of lifting arms spaced apart by a distance shorter than a diameter of the vehicle tire so the arms of each fork releasably engage a corresponding one of the tires on an underside thereof and on opposite sides of the tire's axis of rotation; and a pneumatic pressure supply system adapted for connection to a source of air under pressure and having a pneumatic pressure distributing t-joint with an inlet for connection to an air pressure supply line from the air pressure source, and a pair of air pressure distribution lines connected to outlets of the T-joint for simultaneously uniformly distributing air under pressure from the air pressure source directly to the cylinders of the two jacks so the pistons and piston rods thereof are uniformly lifted to equally and simultaneously raise the carriages and their corresponding lifting arms, thereby equally raising the vehicle from balanced lifting pressure applied from the lifting arms equally to the underside of the tires.

9. Apparatus according to claim 8 in which each fork is releasably connected to its corresponding carriage.

* * * * *